United States Patent [19]

Bedwell et al.

[11] Patent Number: 4,739,903

[45] Date of Patent: Apr. 26, 1988

[54] DISPENSING CASE ASSEMBLY

[75] Inventors: Hubert A. Bedwell, Sycamore Township, Hamilton County; Ronald C. Dreyer, Cheviot, both of Ohio

[73] Assignee: Fibre Glass-Evercoat Company, Inc., Cincinnati, Ohio

[21] Appl. No.: 913,971

[22] Filed: Oct. 1, 1986

[51] Int. Cl.[4] ..... B65D 88/62

[52] U.S. Cl. ..... 222/95; 222/105; 222/326; 222/386; 222/561

[58] Field of Search ..... 222/95, 105, 561, 131, 222/106, 183, 92, 559, 107, 386, 541, 545, 325–327

[56] References Cited

U.S. PATENT DOCUMENTS

| | | | |
|---|---|---|---|
| 2,618,409 | 11/1952 | Eisenberger et al. | 222/95 |
| 3,344,958 | 10/1967 | Kaaneke | 222/559 X |
| 4,331,266 | 5/1982 | Bond | 222/561 X |
| 4,516,692 | 5/1985 | Croley | 222/131 X |
| 4,599,625 | 7/1986 | Terasawa et al. | 222/95 X |
| 4,637,531 | 1/1987 | Olsson | 222/559 |

*Primary Examiner*—Joseph J. Rolla
*Assistant Examiner*—Nils E. Pedersen
*Attorney, Agent, or Firm*—James W. Pearce; Roy F. Schaeperklaus

[57] ABSTRACT

A device for dispensing plastic material from a bag-like container. A case surrounds the bag-like container. An opening in a wall of the case receives the spout of the bag-like container. A panel of the case is releasable and can be urged along the case while bearing on the bag-like container to cause discharge of contents of the bag-like container through the spout.

3 Claims, 4 Drawing Sheets

FIG. 11
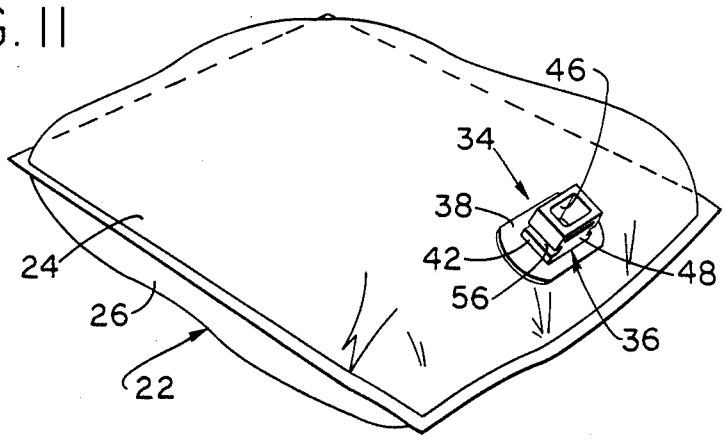
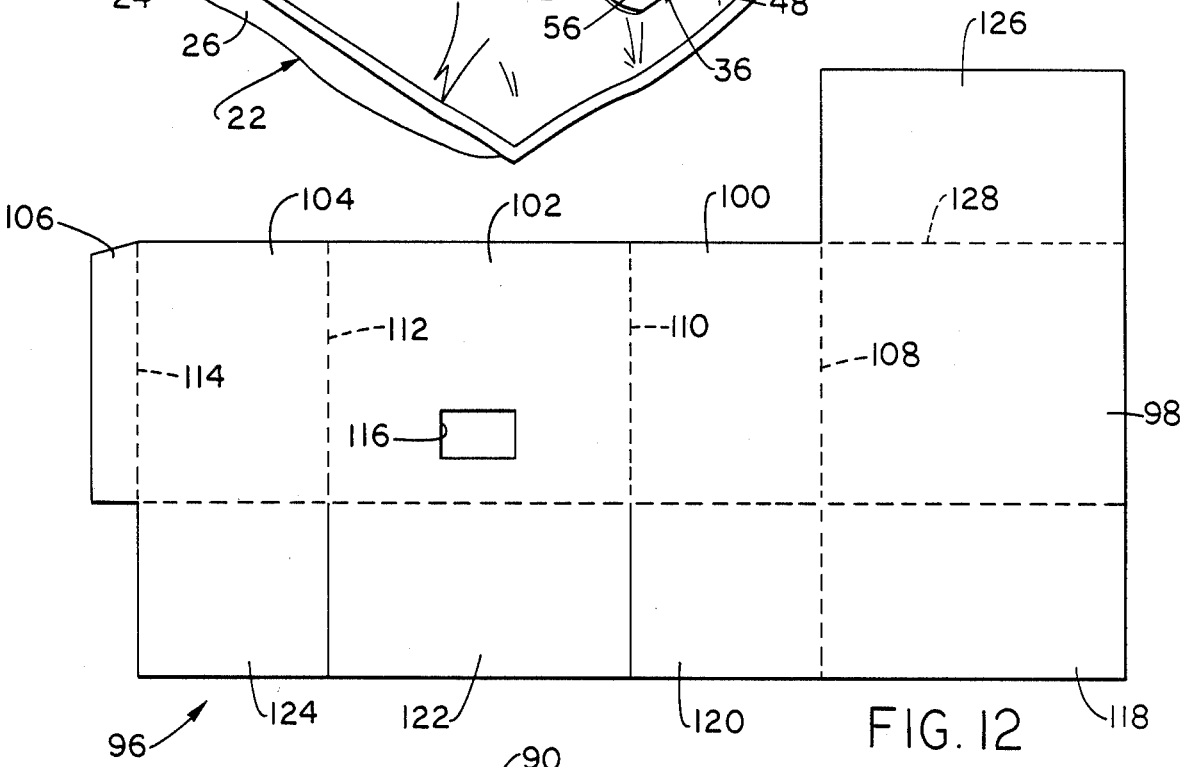
FIG. 12
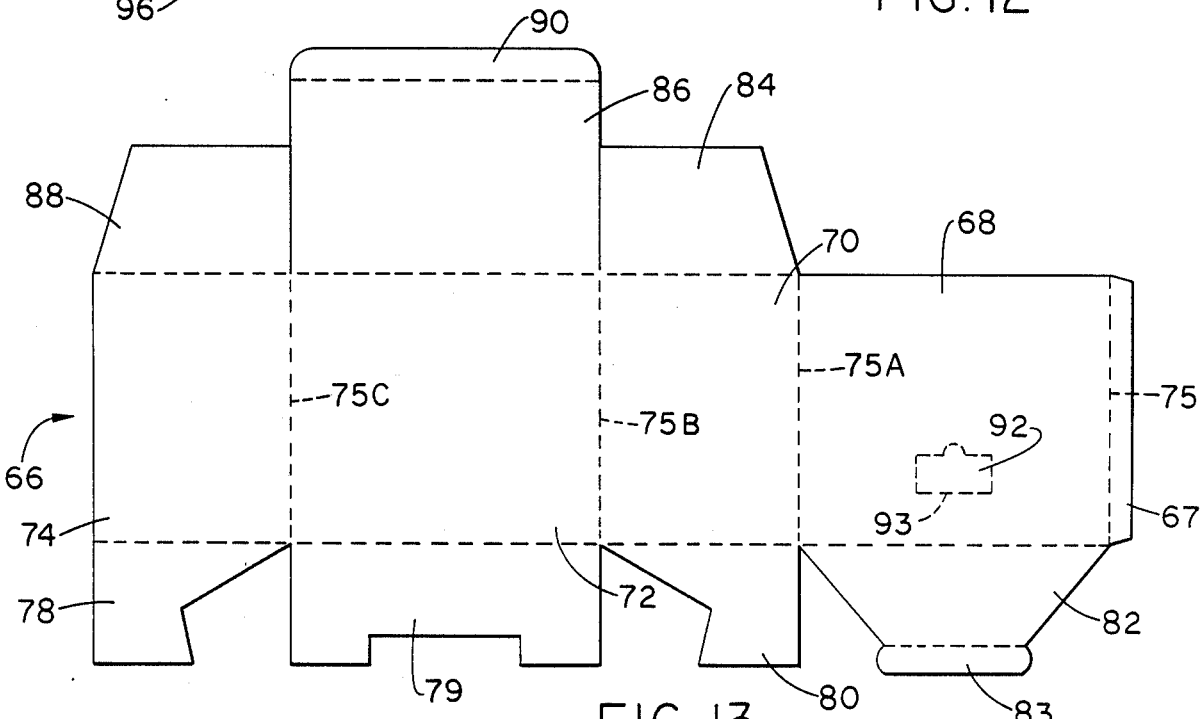
FIG. 13

DISPENSING CASE ASSEMBLY

BACKGROUND OF THE INVENTION

This invention relates to a case assembly for dispensing plastic material from a bag-like container having flexible walls. More particularly, this invention relates to a combined protective cover for a bag-like container of plastic material and a dispensing device for the plastic material.

The bag-like container can be similar to that shown and described in our co-pending applications Ser. Nos. 06/903,970 filed Sept. 5, 1986 for DISPENSING DEVICE and 07/091,079 filed Aug. 31, 1987 for BAG-LIKE CONTAINER, each the invention of Hubert A. Bedwell and Ronald C. Dreyer. The container has flexible walls. A spout is mounted on one of the flexible walls.

BRIEF DESCRIPTION OF THE INVENTION

Briefly, this invention provides a bag-like container which is mounted inside an inner case having substantially rigid panels. An outer case encloses the inner case. One wall of the inner case has an opening for receiving the spout of the bag-like container. A wall of the outer case also has an opening for receiving the spout. When the container spout extends through the walls of the inner and outer cases, a bracket can be mounted on the spout to hold the spout in dispensing position. A panel of the case can be released and the panel can be advanced through the case to cause discharge of the plastic material through the spout. The bracket has a closure plate portion which can move between an open position at which contents of the bag-like container can be discharged through the spout and a closed position in which the spout is closed by the closure plate.

The above and other objects and features of the invention will be apparent to those skilled in the art to which this invention pertains from the following detailed description and the drawings in which:

BRIEF DESCRIPTION OF THE DRAWINGS

FIG. 11 is a perspective view of the bag-like container;

FIG. 12 is a plan view of a blank from which an inner case of the dispensing case assembly is formed; and FIG. 13 is a plan view of a blank from which an outer case of the dispensing case assembly is formed.

In the following detailed description and the drawings, like reference characters indicate like parts.

DESCRIPTION OF PRESENTLY PREFERRED EMBODIMENT

In FIGS. 1–4 inclusive is shown a case assembly 20 for dispensing plastic material from a bag-like container which is constructed in accordance with an embodiment of this invention.

Figure 5:
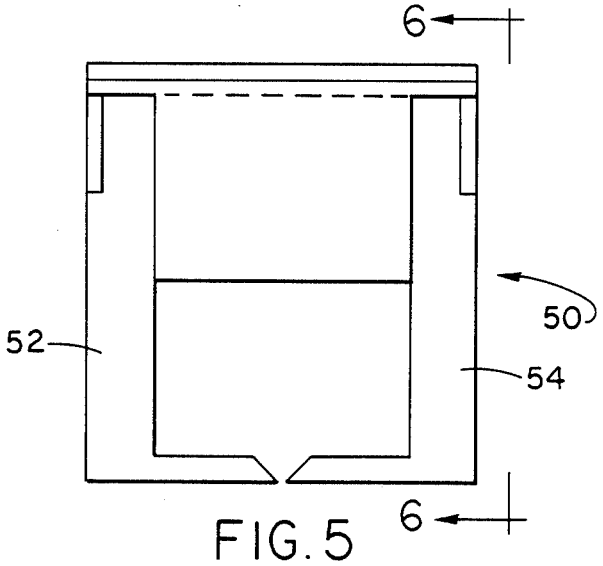
FIG. 5 is a view in front elevation of the spout holding bracket removed from the case assembly.
Figure 6:
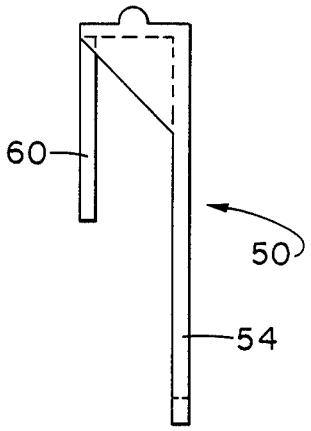
FIG. 6 is a view in side elevation of the spout holding bracket looking in the direction of the arrows 6—6 in FIG. 5.
Figure 7:
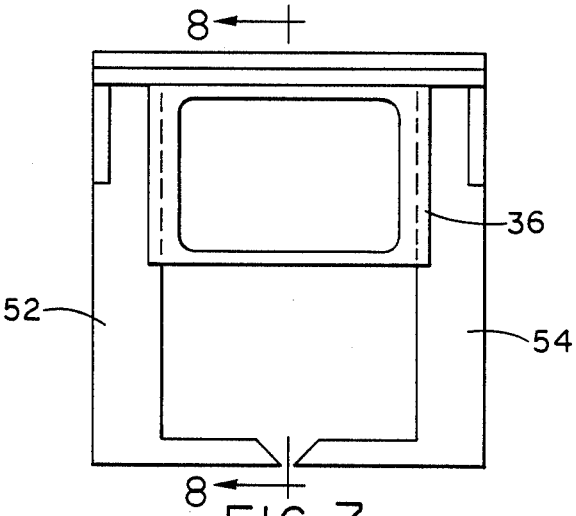
FIG. 7 is a view in front elevation of the spout holding bracket and of the spout removed from the rest of the case assembly, the bracket being shown in spout closed position.
Figure 8:
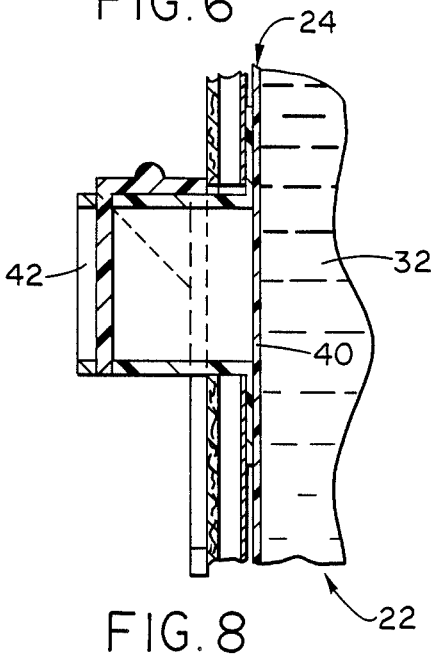
FIG. 8 is a view in section taken on the line 8—8 in FIG. 7, fragmentary details of the bag-like container and of inner and outer cases being shown, a portion of the bag-like container covering and closing the spout.
Figure 9:
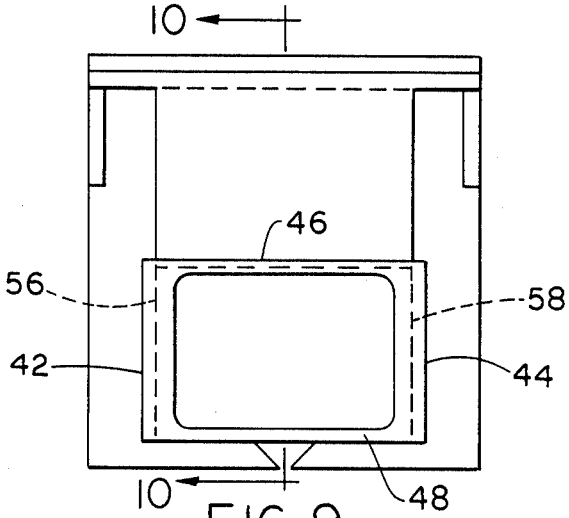
FIG. 9 is a view in front elevation of the spout holding bracket and of the spout removed from the rest of the case assembly, the bracket being shown in spout open position.

The case assembly 20 includes a bag-like container 22 having flexible walls 24 and 26, an inner case 28, and an outer case 30. The walls 24 and 26 are sealed together at edges thereof as shown in FIG. 11. The bag-like container 22 is filled with plastic material 32 such as the type of material which is used to fill dents and the like in panels of a vehicle body (not shown). A spout assembly 34 is mounted on the wall 24. The spout assembly includes a tubular body 36 and an outwardly extending flange 38. The flange 38 is firmly attached to the wall 24. A portion 40 of the wall 24 normally closes the spout 34. The portion 40 can be cut away to form an opening and to permit discharge of the contents of the bag-like container 22 through the spout 34. The spout body 36 is of rectangular cross-section and includes side panels 42 and 44, an upper panel 46 and a lower panel 48. A closure bracket 50 (FIGS. 5 and 6) can be mounted on the spout body 36. The closure bracket includes support arms 52 and 54 which slide in upright slots 56 and 58 formed in the side panels 42 and 44, respectively. A tongue 60 can slide in openings 62 and 64 in the upper panel 46 and the lower panel 48, respectively, and can move between a spout open position shown in FIG. 10 and a spout closed position shown in FIG. 8.

The outer case 30 is formed from a blank 66 shown in FIG. 13. The blank 66 includes a tab 67, front panel 68, a first side panel 70, a back panel 72, and a second side panel 74 hinged together tandem-wise at hinge lines 75, 75A, 75B and 75C. The tab 67 can be attached to the second side panel 74. Lower panels 78, 79, 80 and 82 hinged to the second side panel 74, the back panel 72, the first side panel 70 and the front panel 68, respectively, can be folded together to form a lower closure for the outer case. A tab 83 hinged to the lower panel 82 completes the lower closure.

Figure 1:
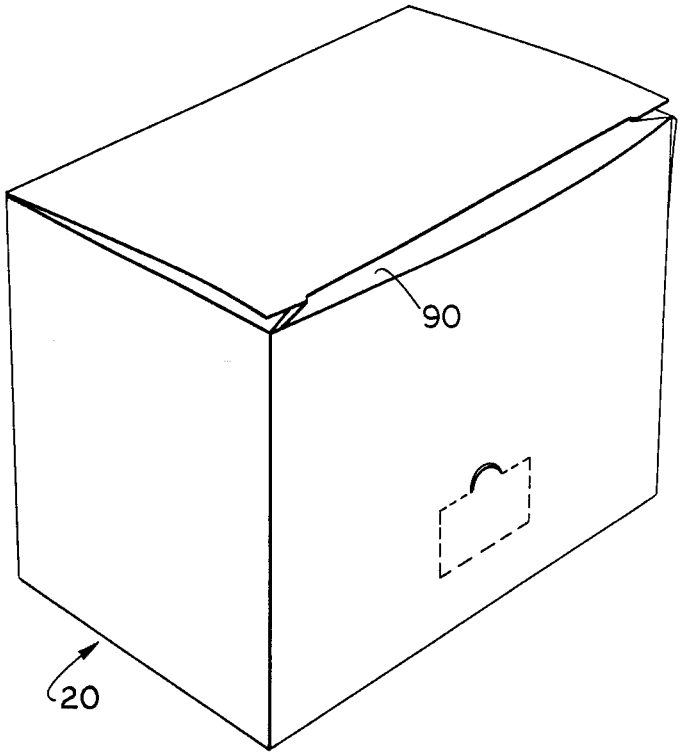
FIG. 1 is a perspective view of a case assembly for dispensing plastic material, which is constructed in accordance with an embodiment of this invention, the case assembly being shown closed.
Figure 2:
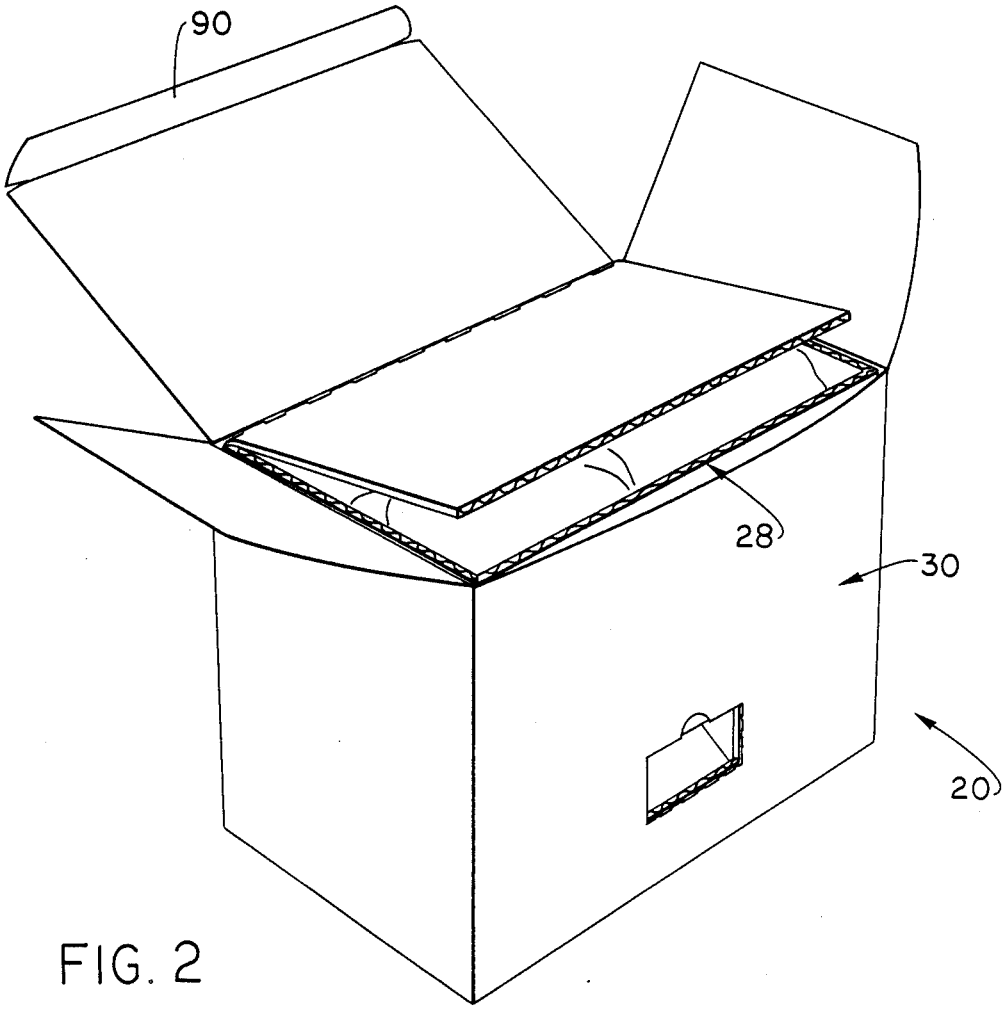
FIG. 2 is a perspective view of the case assembly in partly open position.
Figure 3:
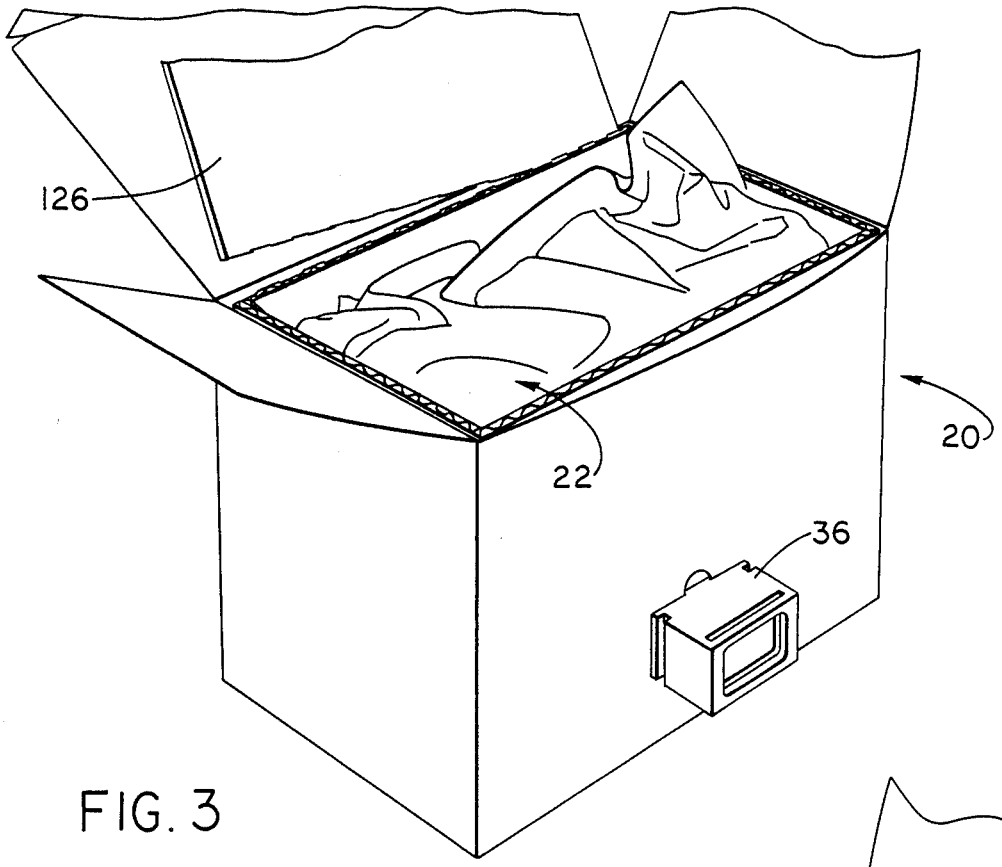
FIG. 3 is a perspective view of the case assembly in open position with a pressure panel thereof partly released.

A first upper side panel 84, an upper main panel 86 and a second upper side panel 88 hinged to the first side panel 70, the back panel 72 and the second side panel 74, respectively, can be folded to form a top closure. A tab 90 hinged to the upper main panel 86 can be tucked behind the front panel 68 as shown in FIG. 1. A portion 92 of the front panel 68 can be defined by perforations 93 and can be separated from the front panel 68 to form an opening on the front panel 68.

The inner case 28 can be formed from a blank 96 (FIG. 12) of corrugated board material. The blank 96 includes a back panel 98, a first side panel 100, a front panel 102, a second side panel 104, and a tab 106 hinged together tandem fashion by hinge lines 108, 110, 112 and 114. An opening 116 is formed in the front panel 102 for receiving the spout body 36. The tab 106 can be adhesively attached to the back panel 98 to form the inner case. Lower panels 118, 120, 122 and 124 are hinged to the back panel 98, the first side panel 100, the front panel 102, and the second side panel 104, respectively, and can be folded together to form a lower closure for the inner case 28. A top pressure panel 126 is connected to the rear panel 98 by a row of perforations 128.

Figure 4:
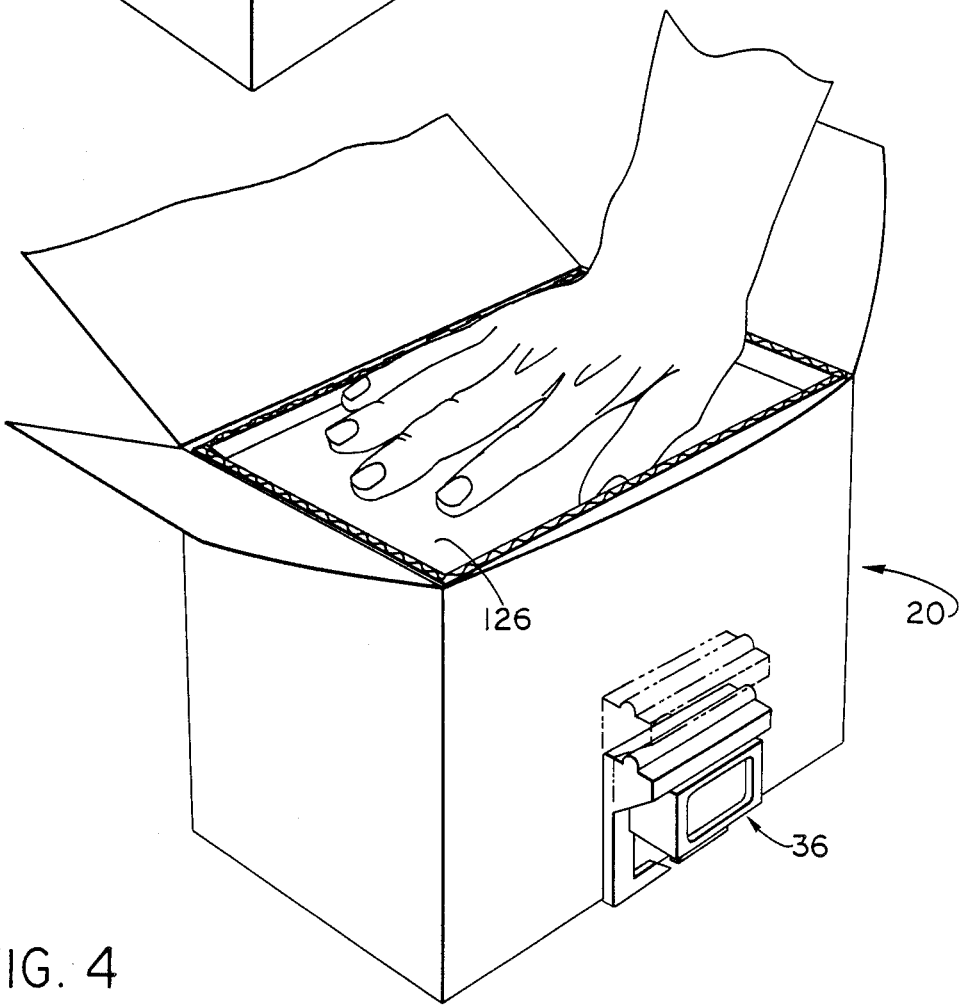
FIG. 4 is a perspective view of the case assembly in open position with the pressure panel in partly lowered position, a spout holding bracket being shown in open position in dot-dash lines and in closed position in full lines.
Figure 10:
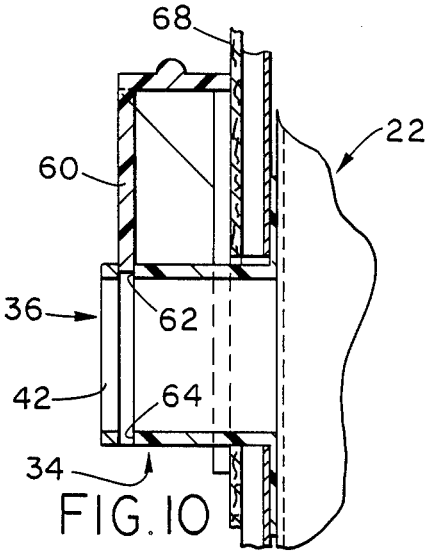
FIG. 10 is a view in section taken on the line 10—10 in FIG. 9, fragmentary details of the bag-like container and of the inner and outer cases being shown.

When the case assembly 20 is to be used for dispensing plastic material, the top pressure panel 126 of the inner case 28 is removed at the perforations 128 and the spout body 36 can be directed through the opening 116 in the inner case 28 and through the space left by removal of the portion 92 of the front panel 68 of the outer case 30 as shown in FIG. 10. The bracket 50 is mounted on the spout body 36 to hold the spout body 36 in position, and the closure panel portion 40 of the wall 24 of the bag-like container 22 is cut away to permit discharge of contents of the bag-like container 22 through the spout 34. As shown in FIG. 4, the top pressure panel 126 can be pushed downwardly through the inner case 28 to cause discharge of the contents of the bag-like container 22. When sufficient of the material has been discharged, the bracket 50 can be advanced to the FIG. 8 position to shut off flow of the plastic material through the spout.

The dispensing device illustrated in the drawings and described above is subject to structural modification without departing from the spirit and scope of the appended claims.

Having described our invention, what we claim as new and desire to secure by letters patent is:

1. A device for dispensing plastic material from a bag-like container having flexible walls and spout means mounted on one of the walls which comprises a case surrounding the bag-like container, there being an opening in a wall of the case for receiving the spout means of the bag-like container, there being a piston panel of the case attached to another panel of the case by a releasable line of weakening, the piston panel when released from the other panel being urgeable along the case for bearing on the bag-like container to cause discharge of contents of the bag-like container through the spout, the device including a bracket mounted on the spout means and bearing on another panel of the case annularly of the opening in the wall of the case receiving the spout means to hold the spout in position on the case, the bracket being slideably mounted on the spout for movement transversely thereof, the bracket carrying a closure plate which advances between a spout open position and a spout closed position as the bracket is slid.

2. A device for dispensing plastic material from a bag-like container having flexible walls and spout means mounted on one of the walls which comprises an inner case surrounding the bag-like container, there being an opening in a wall of the inner case for receiving the spout of the bag-like container, and an outer case surrounding the inner case, there being a portion of the outer case bounded by a line of weakening and removable to provide an opening in the outer case aligned with the opening in the inner case for receiving the spout, a bracket slideably mountable on and for movement transversely of the spout adjacent an exterior face of the outer case to secure the spout in position for discharge of plastic material dispensed from the bag-like container, a closure plate carried by the bracket in and between spout open position and spout closed position as the bracket is slid, a panel of the inner case being releasable, the panel being urgeable along the case for bearing on the bag-like container to cause discharge of contents of the bag-like container through the spout when the closure plate is in open position.

3. A device as in claim 2 in which the outer case has a closure flap swingable to open position in which the urgeable panel may be accessed and actuated and swingable to closed position in which the urgeable panel is retained inside the outer case.

* * * * *